US006304590B1

(12) United States Patent
Roberts

(10) Patent No.: US 6,304,590 B1
(45) Date of Patent: Oct. 16, 2001

(54) FORMATION OF METAL WIRE

(75) Inventor: Raymond J. Roberts, Voorhees, NJ (US)

(73) Assignee: Consarc Corporation, Rancocas, NJ (US)

( * ) Notice: Subject to any disclaimer, the term of this patent is extended or adjusted under 35 U.S.C. 154(b) by 0 days.

(21) Appl. No.: 09/613,483

(22) Filed: Jul. 11, 2000

(51) Int. Cl.[7] ..... H05B 6/02; H05B 6/10

(52) U.S. Cl. ..... 373/138; 373/156; 373/59; 219/605; 219/635

(58) Field of Search ..... 373/42, 56, 59, 373/1, 4, 71, 76, 138, 139, 166; 219/600, 602, 605, 635, 636; 72/40–44, 46; 76/107.4

(56) References Cited

U.S. PATENT DOCUMENTS 4,058,668 * 11/1977 Clites ..... 373/76
5,537,849 * 7/1996 Kawakami et al. ..... 72/43
5,698,124 * 12/1997 DiMarcello et al. ..... 219/635
5,848,093 * 12/1998 Goudeau et al. ..... 373/157
5,957,005 * 9/1999 Einset et al. ..... 76/107.4
6,104,742 * 8/2000 Carter, Jr. et al. ..... 373/42

* cited by examiner

*Primary Examiner*—Tu Ba Hoang
(74) *Attorney, Agent, or Firm*—Drinker Biddle & Reath LLP

(57) ABSTRACT

An increased diameter wire is formed by drawing a feed wire through a cooled nozzle located in a cooled crucible, and through a liquid metal bath contained within the crucible. Liquid metal freezes onto the feed wire as it passes through the bath, thereby increasing the diameter of the feed wire to form an increased diameter wire product. The invention is particularly suited to forming a wire from a metal composition that would undesirably react with refractory apparatus.

21 Claims, 3 Drawing Sheets

FORMATION OF METAL WIRE

FIELD OF THE INVENTION

The present invention relates to the formation of metal wire by freezing molten metal onto a feed wire as it passes through a liquid metal bath.

BACKGROUND OF THE INVENTION

Wire can be formed by running a small diameter feed wire through a liquid metal bath held in a refractory container. As the feed wire passes through the bath, liquid metal freezes onto the feed wire to produce a wire of increased diameter. Consequently, the process can be referred to as "freeze-forming."

A prior art freeze-forming process, as illustrated in FIG. 1 and further described below, has been used to make stainless steel wire, but is unsuitable for the manufacture of wire formed from a metal that will react with the refractory materials used for the molten metal container 130, the nozzle 125 and the stopper rod 122. A chemically reactive metal, in its molten state, will attack and decompose refractory materials with which it comes into contact.

A suitable substitute for the refractory container, namely a cooled, segmented, metallic crucible, is disclosed in U.S. Pat. No. 4,058,668 entitled Cold Crucible. However, this does not solve the problem of reactive metal attack on the refractory stopper rod and nozzle shown in FIG. 1. In the present invention, the stopper rod is eliminated and the refractory nozzle is replaced by a water-cooled nozzle, inside which the metal is heated. Therefore, the present invention overcomes the problems of the prior art for freezing-forming a reactive metal wire.

SUMMARY OF THE INVENTION

The invention in its broadest aspect is a method for forming an increased diameter wire from a feed wire. A cooled crucible is provided. A liquid metal bath is established in the cooled crucible. The liquid metal bath is heated, for example, by induction heating. The crucible has a cooled nozzle disposed at least partially below the upper surface of the liquid. Both the crucible and nozzle may be of a segmented design. The liquid metal bath in the vicinity of the nozzle may be separately heated, for example, by induction heating, to prevent the deleterious attachment of skull to the feed wire. Optionally, a dc magnetic field may be applied to the metal bath to control the dynamic fluid properties of the bath. By passing the feed wire sequentially through the opening in the nozzle and the liquid metal bath, metal freezes onto to the feed wire and produce an increased diameter wire.

The increased diameter wire maybe optionally drawn through a die or squeezed between rolls to achieve further control of the diameter. Gas at a positive pressure may be applied around the external opening of the nozzle, preferably at a pressure greater than the pressure applied to the upper exposed surface boundary of the liquid metal bath. The method may use multiple nozzles with each nozzle having a feed wire drawn through it to form multiple freeze-formed wire products. The method is particularly applicable to chemically reactive molten metal compositions.

In another aspect, the invention is an apparatus for forming a freeze-formed wire product from a feed wire. The apparatus includes a cooled crucible that has a cooled nozzle. A liquid metal bath is contained within the crucible. The cooled crucible and nozzle may be segmented. The liquid metal bath is heated, for example, by an induction heating system. The feed wire is drawn sequentially through the opening in the cooled nozzle and liquid metal bath to form a freeze-formed wire product. A separate heating system may be provided for heating metal liquid in and in the vicinity of the cooled nozzle. The apparatus may also include means for applying a dc magnetic field to the liquid metal bath. Means may be provided for applying a gas at a positive pressure by, for example, providing an enclosure around the exterior opening of the cooled nozzle and injecting gas into the enclosure.

A reading of the following description and appended claims will provide a thorough understanding of the invention.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
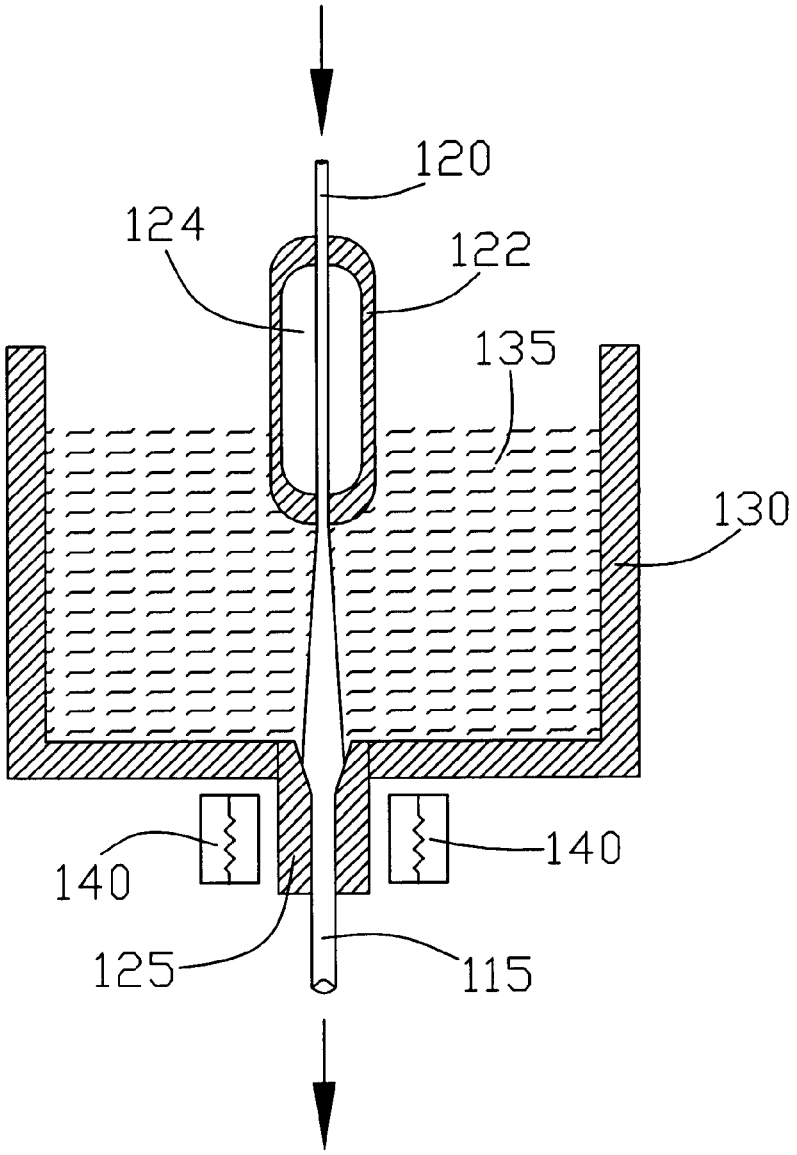
FIG. 1 PRIOR ART
FIG. 1 is a cross sectional view of a prior art apparatus for freeze-forming a wire.

In the prior art, as illustrated in FIG. 1, a feed wire 120 is fed through a refractory stopper rod 122 into a liquid metal 135 held in refractory container 130 in the direction indicated by the arrows. The stopper rod is partially submerged in the liquid metal bath. An inert gas is injected into the enclosed interior 124 of the stopper rod to provide a positive pressure, which prevents liquid metal from penetrating the interior cavity of the stopper rod via the submerged annular clearance between the stopper rod and feed wire. The stopper rod 122 can be raised or lowered to adjust the amount of metal frozen onto the feed wire. Metal is maintained in the liquid state by conventional heating apparatus. As the feed wire 120 passes through the liquid metal bath, liquid metal freezes onto it, and the diameter of the wire increases. The freeze-formed wire 115 exits the bath through heated refractory nozzle 125, which sizes the exiting freeze-formed wire. The refractory container 130, stopper rod 122 and nozzle 125 are generally cylindrical in shape. A heater 140 heats the nozzle 125 to maintain the wire passing through the nozzle at an elevated temperature conducive to the sizing operation.

If the apparatus were to be used with a liquid metal that would react significantly with the refractory material used for container 130, stopper rod 122 and nozzle 125, these components would deteriorate, contaminating the metal in the bath and likely rendering the apparatus unusable.

Figure 2:
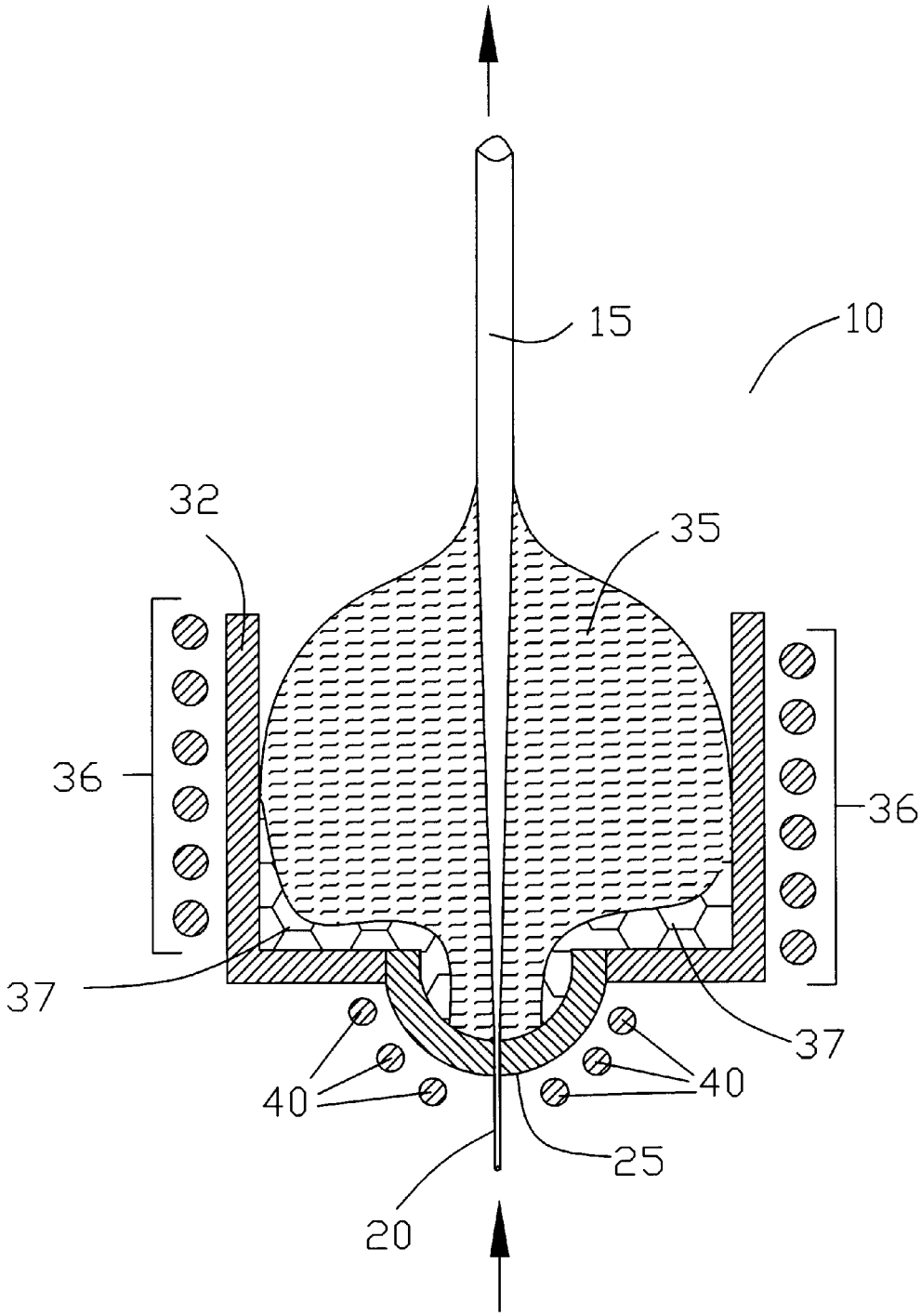
FIG. 2 is a cross sectional view of one embodiment of the present invention for freeze-forming a wire.

There is shown in FIG. 2, in accordance with the present invention, apparatus 10 for freeze-forming a wire 15 that overcomes the problems of using the prior art illustrated in FIG. 1 with such reactive metals. A feed wire 20 is fed through a cooled nozzle 25 into a liquid metal 35 held within a cooled crucible 32. The liquid metal may be established in the crucible by pouring molten metal into the crucible or by melting metal within the crucible. The term "liquid metal" is used to describe both single metal and mixed metal compositions. The nozzle 25 is typically disposed at least partially below the upper surface of the liquid metal. The feed wire 20 is drawn upward, as indicated by the arrows in FIG. 2, to freeze metal onto the feed wire as it passes through the liquid metal 35. A freeze-formed wire 15 emerges from the liquid metal bath. The metal in the crucible and nozzle is heated to keep the metal in a liquid state.

In the apparatus of FIG. 2, for a feed wire of a given diameter, the metal bath temperature, bath depth and wire feed rate all influence the wire diameter increase that actually occurs as the wire passes through the liquid bath. These are all amenable to operator control, thereby enabling a desired exit diameter to be achieved and maintained, though in-line mechanical sizing (e.g., drawing the freeze-formed wire through a die) of the partially or completely solidified wire can still be employed if desired. Typical but not limiting ratios of freeze-formed wire to feed wire diameters are from 1:1 to 10:1. Selection of a particular feed wire diameter will depend upon many factors, including the thermal and mechanical properties of the feed wire relative to the thermal properties of the liquid metal bath and the desired physical properties of the freeze-formed wire. The composition of the feed wire may be the same as or different from the composition of the molten metal bath. Moreover, the invention is not limited to using feed wires of a circular cross section. Other cross sections may be used, the opening in the nozzle having in all cases a shape and size that i allow passage of the feed wire while preventing liquid metal from leaking out.

As shown in FIG. 2, an induction coil 36 is used in this particular embodiment for heating the metal in the crucible although other heating methods such as plasma or electron beam heating might be used. The crucible 32 may be cylindrical in shape, with coil 36 surrounding at least a portion of the outside of the crucible.

A conventional induction power supply (not shown in the figures) is connected to coil 36 to supply alternating current to the coil to inductively heat the liquid metal in the crucible. The power source can be operated at a frequency and power level that maintains the liquid metal at an appropriate process temperature. The power supply and coil form an induction heating system for heating the liquid metal bath in the crucible. In alternative embodiments of the invention, electromagnetically driven internal turbulence and associated surface shape instabilities in the liquid metal bath 35 associated with this induction heating can be reduced by the imposition of an auxiliary magnetic field. For example, a dc current can also be passed through induction coil 36 or a separate coil not shown, to achieve eddy current damping of metal motions in the liquid metal 35. Damping of metal motions makes the contact time between the feed wire 20 and metal liquid 35 more consistent, thereby providing a wire 15 of more constant diameter at the exit point from the liquid metal bath.

As shown in FIG. 2, when a cooled crucible and nozzle are used, one or more areas of solidified metal 37, called skull, tend to form on the bottom and lower sides of the crucible 32, and along the inner wall of the nozzle 25. Any such skull beneficially acts as a non-contaminating container for the liquid and reduces the thermal losses from the liquid to the crucible and nozzle. However, such skull must not be allowed to freeze to across to the wire such that a deleterious attachment is developed between any such skull and the forming wire. This would be most likely to happen in and near the nozzle, where the forming wire is closest to the cooled walls. Accordingly, the metal in this region is supplied with additional heat. In some configurations of the crucible a single coil may be sufficient to heat the liquid metal bath in the crucible including liquid metal in and around the nozzle.

Induction heating of the liquid metal in and near nozzle 25 is achieved by passing an ac current (supplied by a conventional induction power source not shown in the figures) through coil 40. Preferably, induction coil 40 has a power source that is separate from the power source for induction coil 36 to facilitate independent control of the power input to the liquid metal in the crucible and that in or near the nozzle. The induction coil and power source form an induction heating system for heating liquid metal in and around the nozzle.

The heating of the liquid metal in the crucible 32 and nozzle 25 are therefore controlled to preclude any tendency for any skull to deleteriously attach itself to the forming wire at any point. Deleterious attachment generally occurs when there is sufficient skull attachment to significantly degrade the shape, or the internal or surface quality, of the freeze-formed wire as it passes through the liquid metal or when the passage of the feed wire through the nozzle is impeded.

The feed wire can be drawn through the liquid metal bath and -nozzle by means of a conventional mechanical drawing and tensioning system (not shown in the drawings).

Preferably, the crucible 32 and nozzle 25 are generally of the segmented design disclosed in U.S. Pat. No. 4,058,668, which is incorporated herein by reference, the crucible 32 and nozzle 25 being formed from segments to reduce inductive heating in the walls of the crucible and nozzle. While U.S. Pat. No. 4,058,668 shows one particular method of segmenting the crucible and nozzle, other segmentations of the crucible and nozzle are acceptable for the present invention. Passages are provided though the segmented crucible 32 and nozzle 25 in order to allow a cooling medium, such as water, to flow through the crucible and nozzle.

Figure 3:
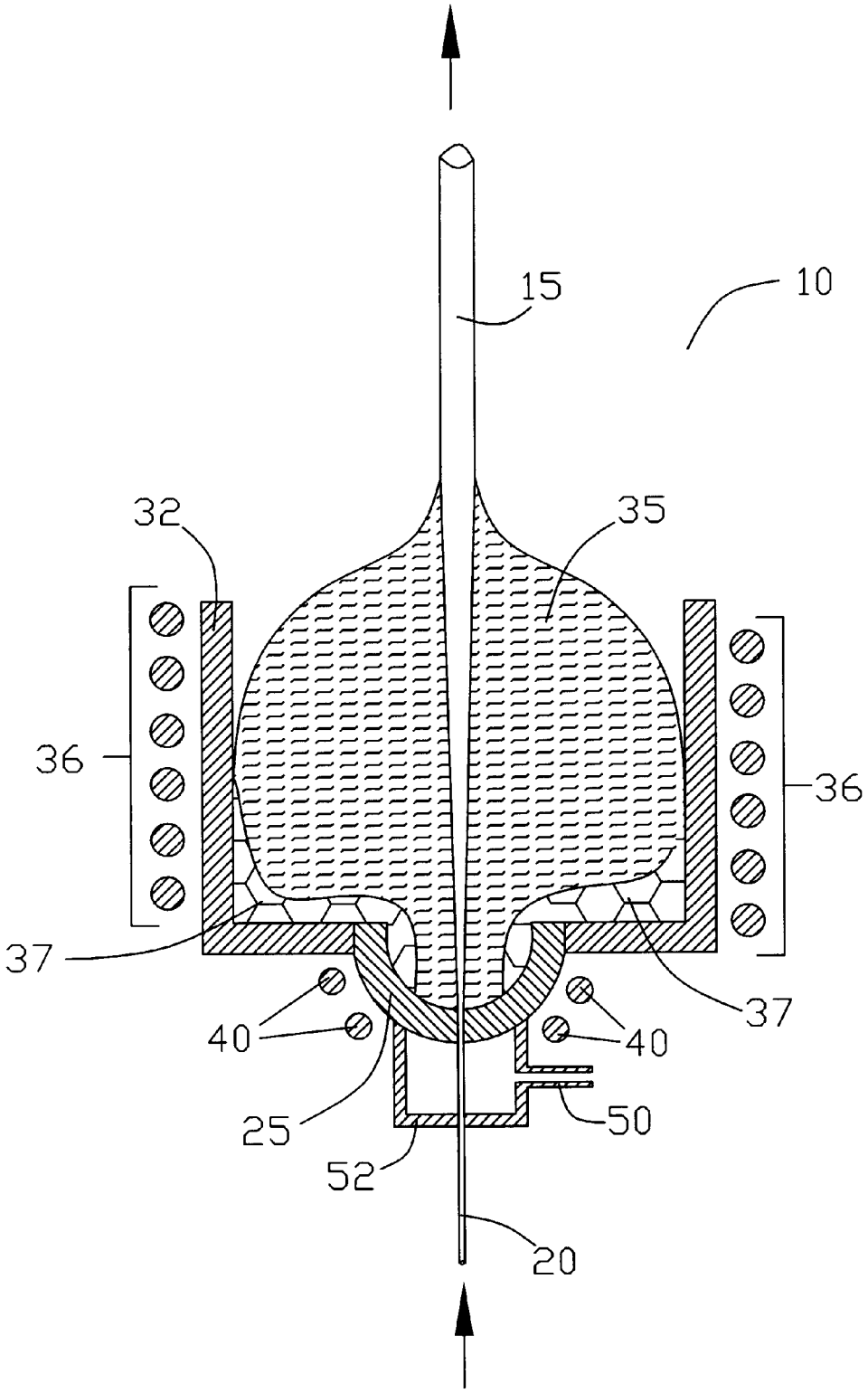
FIG. 3 is a cross sectional view of a second embodiment of the present invention for freeze-forming a wire.

FIG. 3 illustrates an alternative embodiment of the present invention in which an inert gas is fed into an enclosed area around the external opening of the nozzle 25. An inert gas is fed into enclosed chamber 52 through port 50. Preferably, gas in the chamber 52 is maintained at a pressure above that at the upper exposed surface boundary of the liquid metal (i.e., the surface boundary of liquid metal that is not in contact with the crucible or metal skull) in the crucible 32. This excess gas pressure has the effect of reducing the contact pressure between the liquid metal and the cold wall of the nozzle, reducing the heat losses from the liquid metal to the nozzle. This makes it easier to maintain an area of liquid metal around the wire, to prevent the skull from deleteriously attaching itself to the wire. It is not necessary to fully support the metal liquid by gas pressure. Even a decrease in contact pressure between the metal and the nozzle will reduce the said heat losses, thereby helping to achieve the same end.

In FIGS. 2 and 3, the nozzle 25 is shown as being generally hemispherical, with induction coil 40 surrounding the exterior opening of the nozzle and, at least partially the exterior surface of the nozzle. The artisan will appreciate that the configuration of crucible 32, nozzle 25 and their associated induction coils 36 and 40 can be modified, while still preventing any skull in the nozzle or crucible from deleteriously attaching to the feed wire 20. Additionally the frequency and current magnitude in the coils 36 and 40 can be manipulated to prevent the formation of such attachments.

Furthermore, while the opening in the nozzle 25 is shown as generally cylindrical, alternate embodiments of the invention can employ generally conical or other shapes.

The apparatus and process for freeze forming wire as disclosed in the present invention are particularly applicable to applications using chambers that operate under internal vacuum or internal positive pressure. They may also use a controlled atmosphere at essentially ambient atmospheric pressure.

While the disclosed invention is particularly applicable to chemically reactive metal compositions, it can also be used to form wires from non-reactive metal compositions, such as stainless steel. Even with such non-reactive metals, there is almost always some chemical or physical interaction between the liquid metal and any refractory materials with which it comes into contact. in such cases, the absence of refractory materials can be useful to produce wire of high purity, because it is free from the residues of such interactions.

It will also be obvious to the skilled artisan that more than one feed wire may be fed into a single liquid bath, each such feed wire having its own nozzle and such nozzles having associated heating means. Moreover, it is possible for each nozzle to have more than one opening, each such opening having a feed wire.

The foregoing embodiments do not limit the scope of the disclosed invention. The scope of the disclosed invention is covered in the appended claims.

What is claimed is:

1. A method for producing at least one increased diameter wire from an at least one feed wire comprising the following steps:

providing a cooled crucible;

establishing a metal bath in said cooled crucible;

providing at least one cooled nozzle at least partially disposed in said crucible, each of said at least one cooled nozzle having an opening to provide a passage into said crucible for each of said at least one feed wire, said opening disposed below the upper surface boundary of said liquid metal bath;

heating said metal bath to keep said metal bath in an at least partially liquid state;

drawing each one of said at least one feed wire sequentially through said opening in said at least one cooled nozzle and said liquid metal bath, whereby the diameter of each of said at least one feed wire is increased by metal freezing onto said feed wire to form said at least one increased diameter wire.

2. The method of claim 1 further comprising the step of heating the liquid metal bath to prevent the deleterious attachment of skull to said at least one feed wire.

3. The method of claim 2 wherein said heating of the liquid metal bath is accomplished by induction heating.

4. The method of claim 1 wherein said heating the liquid metal bath is accomplished by induction heating.

5. The method of claim 4 further comprising the step of applying an auxiliary magnetic field to the liquid metal bath to dampen liquid motions within said liquid metal bath.

6. The method of claim 1 further comprising the step of applying gas at a positive pressure around the external opening of each of said at least one nozzle.

7. The method of claim 6 wherein said positive pressure is greater than the pressure applied to the upper exposed surface boundary of said liquid metal bath.

8. The method of claim 1 wherein said crucible and each of said at least one nozzle are segmented.

9. The method of claim 1 further comprising the step of drawing each of said at least one increased diameter wire through a die or through rolls.

10. The method of claim 1 wherein said liquid metal bath is chemically reactive with ceramic materials.

11. An apparatus for forming at least one freeze-formed wire from an at least one feed wire comprising:

a cooled crucible;

at least one cooled nozzle equal in number to the number of said at least one feed wire, each of said at least one cooled nozzle having an opening to provide a passage into said crucible for each of said at least one feed wire, said opening disposed below the upper surface boundary of a liquid metal bath contained within said cooled crucible; and means for heating said liquid metal bath; whereby an at least one freeze-formed wire is formed by drawing said at least one feed wire sequentially through said at least one nozzle and said liquid metal bath.

12. The apparatus of claim 11 further comprising means for heating the liquid metal bath to prevent the deleterious attachment of metal skull to said at least one feed wire.

13. The apparatus of claim 12 wherein said means for heating the liquid is an induction heating system.

14. The apparatus of claim 11 wherein said means for heating said liquid metal bath is an induction heating system.

15. The apparatus of claim 11 further comprising means for applying an auxiliary magnetic field to the liquid metal bath to dampen motions in said liquid metal bath.

16. The apparatus of claim 11 further comprising means for applying a gas at positive pressure around the external opening of each of said at least one nozzle.

17. The apparatus of claim 16 wherein said means for applying a gas at positive pressure further comprises an enclosure surrounding the exterior of each of said at least one nozzle and a port in said enclosure for injecting said gas.

18. The apparatus of claim 11 wherein said cooled crucible and said cooled nozzle are segmented.

19. The apparatus of claim 11 wherein at least one of said at least one cooled nozzle is at least partially disposed in the bottom of said crucible.

20. An apparatus for forming at least one wire comprising:

a segmented and cooled crucible;

at least one induction heating coil at least partially surrounding said crucible;

at least one segmented and cooled nozzle;

a liquid metal bath contained within said crucible;

at least one feed wire equal in number to the number of said at least one nozzle, each of said at least one feed wire passing sequentially through one of said at least one nozzle and the liquid metal bath;

at least one induction heating coil disposed in the vicinity of each said at least one nozzle to prevent the deleterious attachment of metal skull to said at least one feed wire; and means for continuously drawing said at least one feed wire sequentially through the opening in said at least one nozzle whereby at least one wire is formed, said at least one wire having a diameter greater than the diameter of said at least one feed wire.

21. An apparatus of claim 19 further comprising an at least one enclosure surrounding the external opening of each one of said at least one nozzles and a port in said at least one enclosure whereby a gas can be injected into said enclosure to maintain a positive gas pressure at the external opening.

* * * * *